US006957908B1

(12) United States Patent
O'Connell et al.

(10) Patent No.: US 6,957,908 B1
(45) Date of Patent: Oct. 25, 2005

(54) ENVIRONMENTAL SHIELD FOR A TRUCK MOUNTED CONCRETE MIXER

(75) Inventors: William J. O'Connell, Frisco, TX (US); Michael B. Calhoun, Carrollton, TX (US); Jack Harowitz, Mesa, AZ (US)

(73) Assignee: Oshkosh Truck Corporation, Oshkosh, WI (US)

( * ) Notice: Subject to any disclaimer, the term of this patent is extended or adjusted under 35 U.S.C. 154(b) by 0 days.

(21) Appl. No.: 09/954,677

(22) Filed: Sep. 15, 2001
(Under 37 CFR 1.47)

(51) Int. Cl.[7] ..... B28C 5/42; B28C 7/14
(52) U.S. Cl. ..... 366/41; 366/54
(58) Field of Search ..... 366/41, 53–63, 366/187, 347, 349

(56) References Cited

U.S. PATENT DOCUMENTS

| | | | | | |
|---|---|---|---|---|---|
| 2,360,345 | A | * | 10/1944 | Hilkemeicr | 366/41 |
| 2,454,940 | A | * | 11/1948 | Peters | 366/41 |
| 2,476,023 | A | * | 7/1949 | Bohannan | 366/41 |
| 2,544,545 | A | * | 3/1951 | Rockburg | 366/41 |
| 2,545,485 | A | * | 3/1951 | Meisenburg | 366/41 |
| 2,572,058 | A | * | 10/1951 | Sarosdy | 366/41 |
| 2,574,184 | A | * | 11/1951 | Jaeger | 366/41 |
| 2,589,492 | A | * | 3/1952 | Graham | 366/41 |
| 2,662,755 | A | * | 12/1953 | Gerst | 366/41 |
| 2,854,224 | A | * | 9/1958 | Broberg | 366/41 |
| 2,902,268 | A | * | 9/1959 | Broberg | 366/41 |
| 2,904,318 | A | * | 9/1959 | Broberg | 366/41 |
| 3,799,221 | A | * | 3/1974 | Vincent | |
| 4,154,534 | A | * | 5/1979 | Lawrence et al. | 366/59 |
| 6,179,463 | B1 | * | 1/2001 | Daniels-Romero | 366/349 |

FOREIGN PATENT DOCUMENTS

| | | | |
|---|---|---|---|
| DE | 3906417 | A1 * | 6/1990 |
| EP | 0706869 | A1 * | 8/1995 |
| EP | 0721828 | A2 * | 12/1995 |
| EP | 1190970 | A1 * | 2/2004 |
| JP | 6-210622 | * | 8/1994 |

* cited by examiner

*Primary Examiner*—Charles E. Cooley
(74) *Attorney, Agent, or Firm*—Foley & Lardner LLP

(57) ABSTRACT

An environmental shield for reducing or eliminating leakage of materials from transit vehicles, including truck-mounted concrete mixers, is provided. The environmental shield preferably engages at least a portion of an opening on a mixer drum such that the leakage that generally occurs in such situations as travel along hilly or bumpy terrain, surging, etc. may be prevented or minimized. The environmental shield preferably includes a discharge cover and a combination steel/rubber abrasion resistant sealing member and may be preferably coupled to a charging hopper of the transit vehicle.

17 Claims, 4 Drawing Sheets

ENVIRONMENTAL SHIELD FOR A TRUCK MOUNTED CONCRETE MIXER

TECHNICAL FIELD OF THE INVENTION

The present invention relates generally to preventing the leakage of wet concrete from a concrete mixer and, more particularly, to an environmental shield for preventing leakage from a truck-mounted concrete mixer.

BACKGROUND OF THE INVENTION

In part to enable transit concrete mixers to transport greater payloads, a reduction in weight of the concrete mixers has been commonly pursued. One technique to reduce the weight of truck mounted concrete mixers has been to eliminate a rear, closing door previously associated with such mixers. The elimination of the rear, closing door has given rise to the problem of leakage or spillage of wet concrete through the open end of the mixer drum. Such spillage or leakage may result from increased loads, transport across hilly terrain as well as surging of loads during transit.

While some efforts have been made to address the problem of leakage or spillage, they have generally been less than satisfactory. For example, the configuration of mixing blades within a mixer have some effect on maintaining wet concrete within the mixer. However, the mixing blades generally have an effect on minimizing leakage only when the mixer is rotated in the mixing direction. Other methods to address the problem of leakage have been directed principally towards returning any leakage or spillage to the mixer as opposed to preventing or reducing the leakage.

SUMMARY OF THE INVENTION

In accordance with teachings of the present disclosure, a system and apparatus are described for reducing or eliminating the leakage of wet concrete from truck-mounted concrete mixers. In one aspect of the present invention, a charging hopper for use in charging a rotatable mixer is provided. The rotatable mixer preferably includes a drum having a drum opening at one end for receiving and discharging contents. The charging hopper preferably includes a chute having a charging opening and a discharge opening at respective ends thereof. The charging hopper is preferably operable to couple to the drum such that the discharge opening is disposed proximate the drum opening. The charging hopper preferably further includes a discharge cover operably coupled to the chute proximate the discharge opening. At least one flexible sealing member having respective first and second faces may be disposed on the discharge cover such that the flexible sealing member engages at least a lower portion of the drum opening when the rotatable mixer is being charged.

In another aspect, a mixer having a rotatable drum maintained in a frame is provided. The rotatable drum preferably includes a drum opening at one end of the drum operable to receive contents to be agitated and further operable to discharge agitated contents from the drum. A motor preferably coupled to the drum and operable to rotate the drum in the frame is also preferably included on the mixer. The mixer preferably further includes a charging hopper having a chute, a charging opening and a discharge opening disposed proximate the drum opening. The charging hopper preferably further includes an environmental shield disposed proximate the discharge opening of the charging hopper. The environmental shield generally includes a discharge cover having respective first and second faces, a first edge and a generally curved second edge operably coupled to the chute along the first edge. The environmental shield generally includes a discharge cover having respective first and second faces, a first edge and a generally curved second edge operably coupled to the chute along the first edge. The environmental shield preferably further includes a generally cupped sealing member disposed on the second generally curved edge of the discharge cover. The generally cupped sealing member is preferably operable to engage the drum opening such that leakage of contents therefrom may be reduced.

In yet another aspect, a concrete mixer truck having a rotatable mixer mounted thereon is provided. The rotatable mixer preferably includes a drum with a drum opening at one end for receiving contents into and discharging contents from the drum. The mixer preferably farther includes a charging hopper having a discharge opening proximate a first end of a chute and a charging opening proximate a second end of the chute disposed proximate the drum opening. An environmental shield operably disposed proximate the discharge opening of the charging hopper is also preferably included on the concrete mixer truck. The environmental shield preferably includes a discharge cover and at least one sealing member operably coupled thereto. The sealing member is preferably operable to engage at least a lower portion of the drum opening such that leakage of contents therefrom may be reduced.

The present invention provides the advantage of reducing or eliminating material blow-back during the charging cycle of a mixer.

The present invention also provides the technical advantage of a reduction or elimination of dust emissions from a mixer. Such a reduction in dust emissions may result in a reduced environmental impact as well as in reduced maintenance of the mixer.

Additional technical advantages provided by the present invention include safety and clean-up benefits that may result from a reduction or elimination of leakage or spillage from a mixer.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Figure 1:
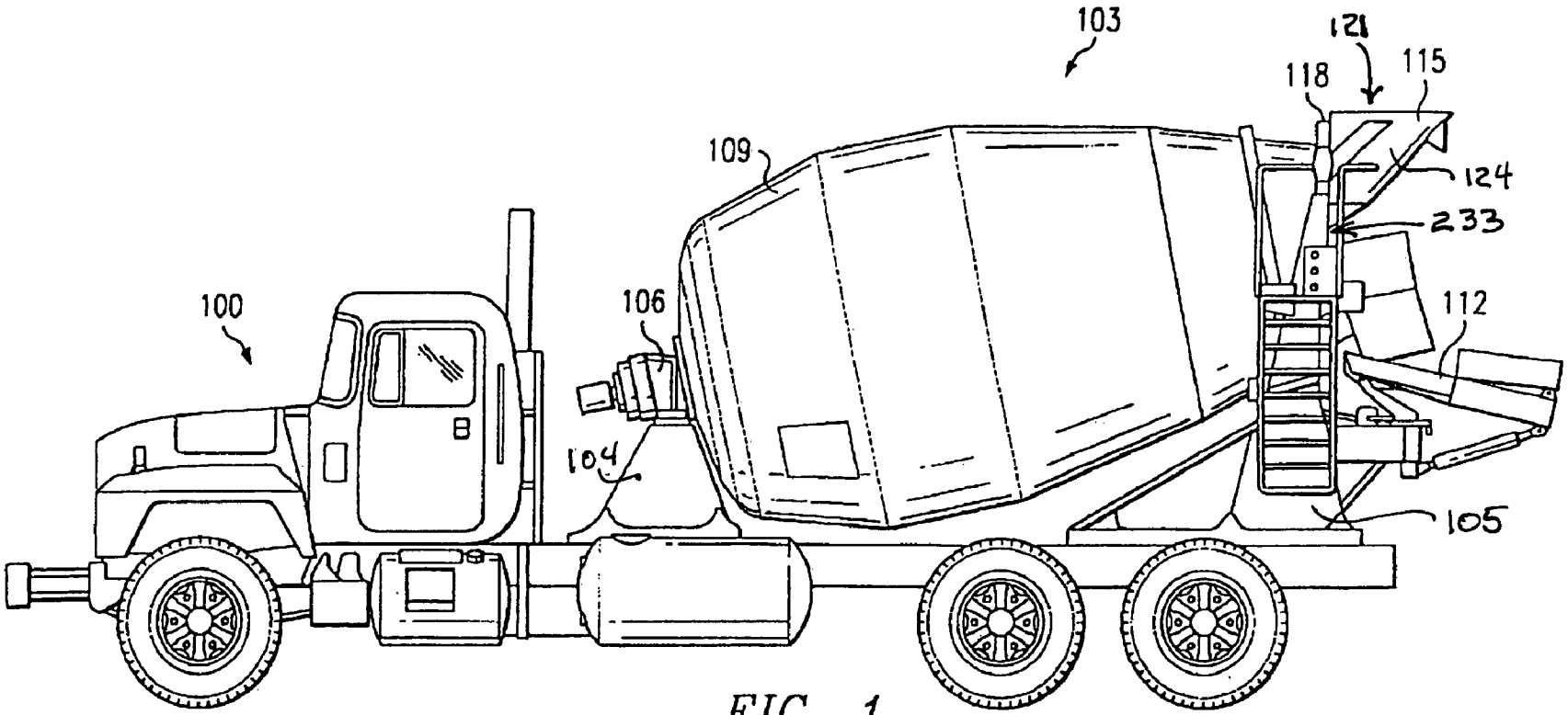
FIG. 1 is a view in elevation illustrating a concrete mixer truck having a truck-mounted mixer incorporating teachings of the present invention.

Preferred embodiments of the invention and their advantages are best understood by reference to FIGS. 1 through 6, wherein like numbers are used to indicate like and corresponding parts. FIG. 1 is a schematic drawing elevation illustrating a concrete mixing truck having a truck-mounted mixer incorporating teachings of the present invention.

Preferably included on transit mixer or concrete mixer truck 100 is mixer 103. Mixer 103 is preferably maintained in a frame that may include mounts 104 and 105. Mixer 103 preferably includes motor 106 operable to rotate drum 109, discharge chute 112 operable to direct contents discharged from drum 109, and charging hopper 115 operable to aid in charging drum 109 with contents, among other components.

Charging hopper 115 is preferably operable to be repositioned. As such, charging hopper 115 may be pivoted or displaced about a pivot point on bracket 118 to allow such repositioning. Other methods and apparatuses for repositioning charging hopper 115 are considered within the scope of the present invention.

One position which charging hopper 115 may assume is a first or charging position. In its first or charging position, illustrated in FIG. 1, charging hopper 115 preferably allows wet concrete, the materials, cement, water and gravel, to make concrete, and/or other materials to be placed into drum 109 through a drum opening preferably included thereon. During charging of drum 109, i.e., when charging hopper 115 is in its first, charging position, an environmental shield preferably disposed thereon may be employed to reduce the amount of leakage or spillage commonly experienced during drum 109 charging operations.

During travel of truck 100, such as after charging drum 109, in route to a job site, charging hopper 115 may be maintained in the first or charging position illustrated in FIG. 1. Maintaining charging hopper 115 in its first or charging position preferably maintains the environmental shield 203 coupled thereto in generally sealably engagement with drum opening 233 (see FIG. 2A) preferably included on drum 109. As a result and in such instances as the surging of contents contained in drum 109 or the travel of concrete mixer truck 100 over sloped or hilly terrain, maintaining charging hopper 115 in its first position enables environmental shield 203 of the present invention to prevent or reduce leakage of contents from drum 109.

During the discharge of contents from drum 109, such as at a job site, charging hopper 115 is preferably displaced from the rear opening 233 (see FIG. 2A) of drum 109. Such a displacement of charging hopper 115 generally involves pivoting charging hopper 115 about bracket 118 such that charging hopper 115 may come to rest in its second position above or aside drum 109 and clear of the drum opening 233 (see FIG. 2A) preferably included thereon. In addition, such displacement of charging hopper 115 preferably alleviates the engagement between the environmental shield 203 and the discharge or drum opening 233 (see FIG. 2A) of drum 109.

Figure 2B:
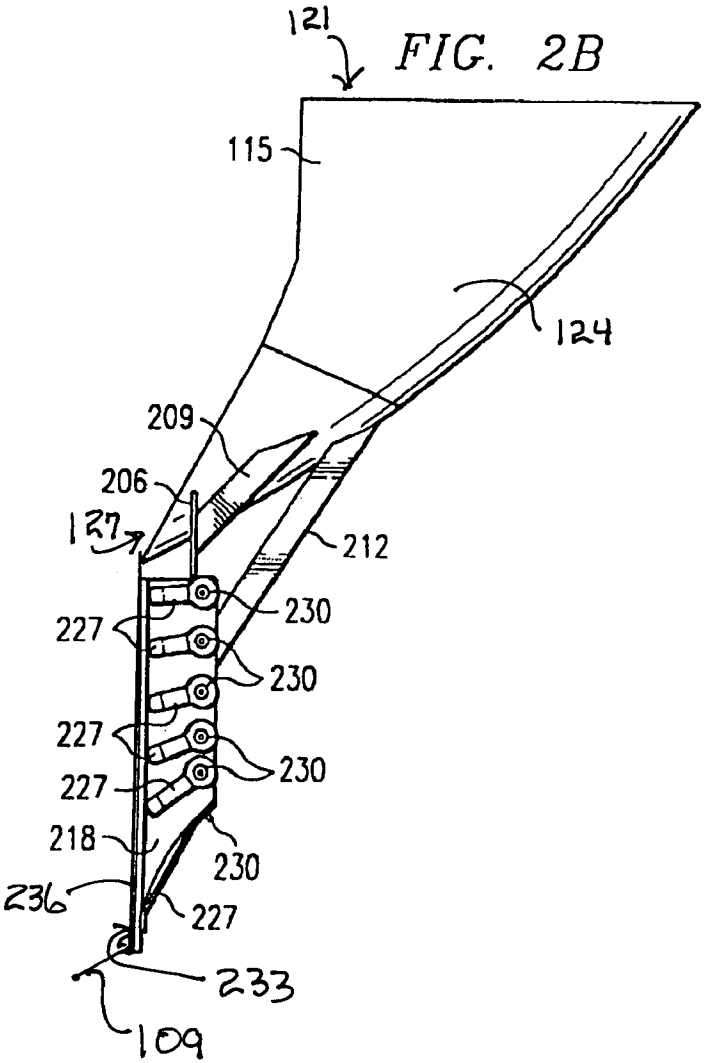
FIG. 2B is a schematic drawing in elevation with portions cut away showing a side view of the charging hopper and environmental shield assembly of FIG. 2A.
Figure 2A:
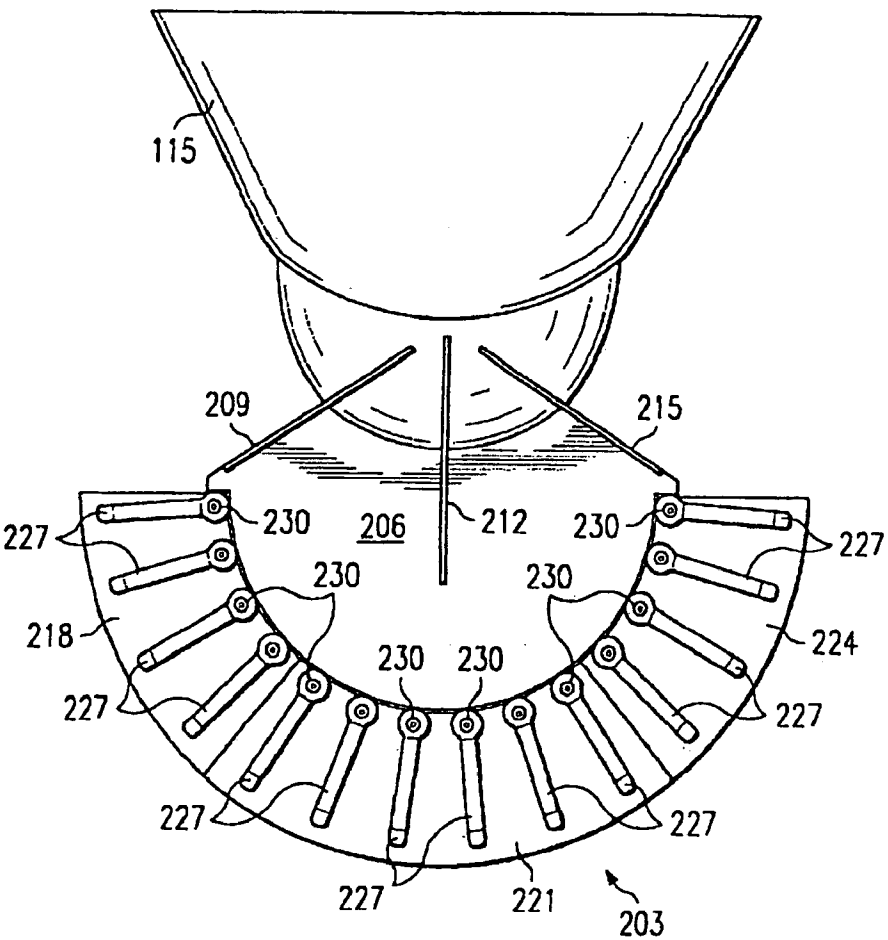
FIG. 2A is a schematic drawing in elevation with portions cut away of the rear portion of the concrete mixer truck of FIG. 1 illustrating a charging hopper and environmental shield assembly incorporating teachings of the present invention.

In FIG. 2A, a plan view with portions cut away depicting the rear portion of concrete mixer truck 100 illustrating a charging hopper 115 and environmental shield 203 combination incorporating teachings of the present invention is shown. Environmental shield 203 may be preferably coupled to charging hopper 115 along a first edge as illustrated in FIG. 2A or by using alternative attachment methods.

Charging hopper 115 preferably includes charging opening 121, chute 124 and discharge opening 127. Charging hopper 115 may be employed in the filling or charging of drum 109. Other embodiments of charging hopper 115 are considered within the scope of the present invention. During charging, charging hopper 115 is generally disposed proximately drum opening 233. Charging opening 121 is preferably positioned near the top of drum 109 such that contents may be inserted therein. Discharge opening 127 is generally positioned proximate to drum opening 233 such that contents placed in charging opening 121 may travel along chute 124 to be released from discharge opening 127 into drum 109.

Environmental shield 203 preferably includes discharge cover 206, first 209, second 212 and third 215 gussets, first 218, second 221 and third 224 flexible sealing members as well as shield fingers 227. Shield fingers 227 are preferably coupled to discharge cover 206 with studs 230 or other mechanical fasteners.

As illustrated in FIG. 2A, environmental shield 203 preferably sealably engages drum opening 233 of drum 109. As further illustrated in FIG. 2A, environmental shield 203 has been designed to cover at least the lower portion of drum opening 233. However, larger environmental shields may be designed to cover a greater portion of drum opening 233.

Environmental shield 203 is preferably maintained in a generally sealed engagement with drum opening 233 such that leakage of contents from drum opening 233 may be reduced. To accomplish such an engagement, flexible sealing members 218, 221 and 224 are preferably held against rim 236 by shield fingers 227. By using shield fingers 227 that are spring biased, a generally constant force may be applied to flexible sealing members 218, 221 and 224 such that they maintain engagement with rim 236 of drum opening 233. A Drip ring may also be present on mixer 103 proximate drum opening 233.

FIG. 2B is a schematic drawing showing a side view with portions broken away of drum 109, charging hopper 115 and environmental shield 203 assembly of FIG. 2A. As mentioned above, environmental shield 203 preferably sealably engages drum opening 233 when charging hopper 115 is in its first or charging position illustrated in FIG. 1. When charging hopper 115 is in its charging position, environmental shield 203 may prevent or reduce leakage or spillage from drum opening 233, and, as further illustrated in FIG. 2B, environmental shield 203 may have a generally concave cupped shape. The concave configuration of flexible sealing members 218, 221 and 224 results, in part, from shield fingers 227, and further enables sealing members 218, 221 and 224 of environmental shield 203 to sealably engage drum opening 233.

Figure 3A:
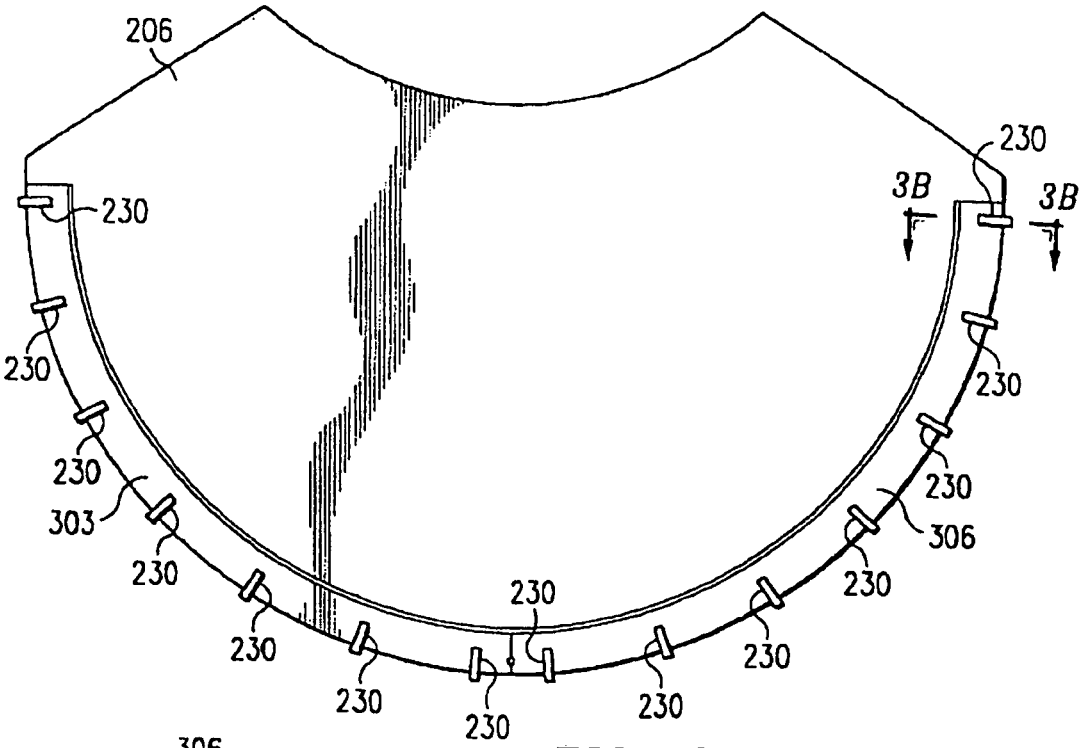
FIG. 3A is a schematic drawing illustrating one embodiment of a discharge cover incorporating teachings of the present invention.

In FIG. 3A, a plan view illustrating an embodiment of discharge cover 206 for use in environmental shield 203 incorporating teachings of the present invention is shown. Discharge cover 206 may be made from various metals such as steel alloys or any other material having satisfactory characteristics. Discharge cover 206 preferably includes first 303 and second 306 discharge lips disposed thereon. Discharge lips 303 and 306 may be employed to maintain studs 230. Studs 230 may be employed to couple sealing members 218, 221 and 224 as well as shield fingers 227 to discharge cover 206. As mentioned above, other methods and apparatus for coupling discharge cover 206 to sealing members 218, 221 and 224 may be employed.

Figure 3B:
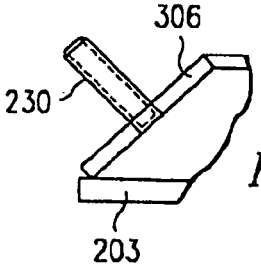
FIG. 3B is a view in elevation with portions cut away of a discharge lip weldment that may be included on the discharge cover of FIG. 3A.

In FIG. 3B, a view in elevation with portions cut away of discharge lip 306 and discharge cover 206 incorporating teachings of the present invention are shown. Discharge lips 303 and 306 may be disposed on discharge cover 203 as illustrated in FIG. 3B. Sloping discharge lips 303 and 306 as illustrated, enables sealing members 218, 221 and 224 to be influenced to take on the generally concave or cupped shape illustrated in FIG. 2B when coupled thereto.

Figure 4A:
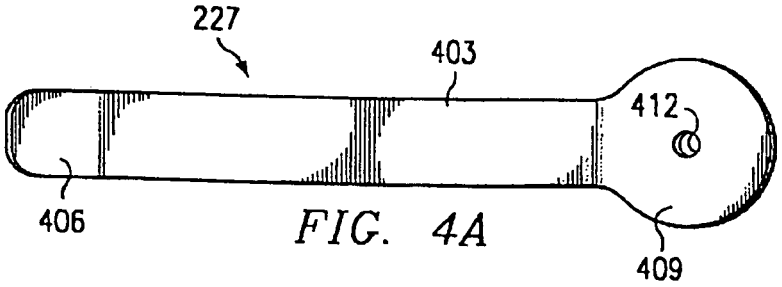
FIG. 4A is a plan view illustrating one embodiment of a shield finger incorporating teachings on the present invention.

In FIG. 4A, a plan view illustrating one embodiment of a shield finger 227 incorporating teachings on the present invention is shown. Shield fingers 227 preferably include body 403, first end 406 and second end 409. Second end 409 preferably includes aperture 412 therein such that shield finger 227 may be attached to stud 230 and/or to discharge lips 303 and 306 and discharge cover 206.

Figure 4B:
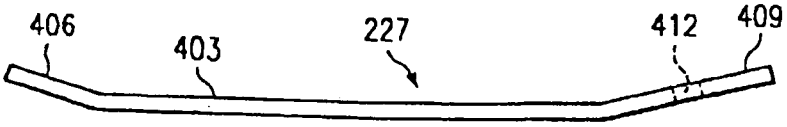
FIG. 4B is a schematic drawing in elevation with portions cut away showing a side view of the shield finger of FIG. 4A.

In FIG. 4B, a view in elevation with portions cut away of shield finger 227 of FIG. 4A is shown. As mentioned above, shield finger 227 may be spring biased. One method to achieve such spring biasing of shield fingers 227 is to include bends in shield finger 227 where first end 406 joins body 403 as well as where second end 409 joins body 403. The generally concave or cupped shape of environmental shield 203 illustrated in FIG. 2B is produced, in part, from the pressure applied by the spring biasing preferably included in the design of shield fingers 227 on sealing members 218, 221 and 224 as well as from the sloped disposition of discharge lips 303 and 306 illustrated in FIGS. 3A and 3B on discharge cover 206.

Figure 5A:
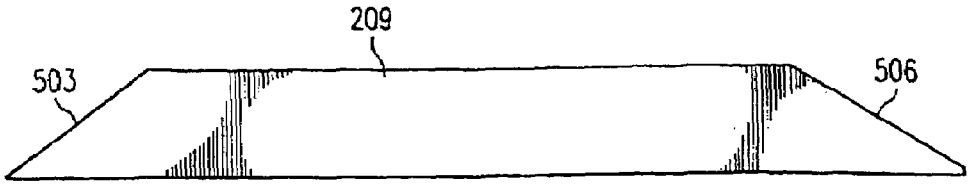
FIG. 5A is an illustration of a side plan view of a gusset.
Figure 5B:
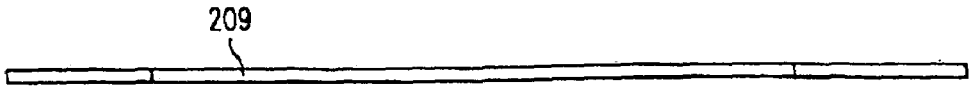
FIG. 5B is an illustration of an edge view of the gusset illustrated in FIG. 5A.

In FIGS. 5A and 5B, a plan view illustrating one embodiment of a gusset, such as gusset 209, 212 or 215, for use with environmental shield 203 incorporating teachings of the present invention is shown. Gusset 209, 212 or 215 may be formed from various metals such as steel alloys, iron or other suitable material. Gussets 209, 212 and 215 preferably include sloped ends 506 and 506. Sloped ends 503 and 506 enable gussets 209, 212 and 215 to be preferably attached to chute 124 of charging hopper 115 and to discharge cover 206 as illustrated in FIGS. 2A and 2B. Gussets 209, 212 and 215 preferably provide structural support to the charging hopper 115 and environmental shield 203 assembly. Other methods of attaching one or more gussets to discharge cover 206 and chute 124 may be employed.

Also in FIGS. 5A and 5B, a view in elevation of a gusset in accordance with teachings of the present invention is shown. Gussets 209, 212 and 215 may be formed from metal sheets. Forming gusset 209, 212 and 215 as illustrated preferably enables environmental shield 203 to be drum opening 233 when charging hopper 115 is disposed in its first or charging position. The force with which environmental shield 203 is held against rear opening 233 of drum 109 is preferably sufficient to create a generally leak-proof seal between drum opening 233 and sealing members 218, 221 and 224 of environmental shield 203 such that the leakage or spillage of materials from within drum 109 may be prevented or reduced.

Figure 6:
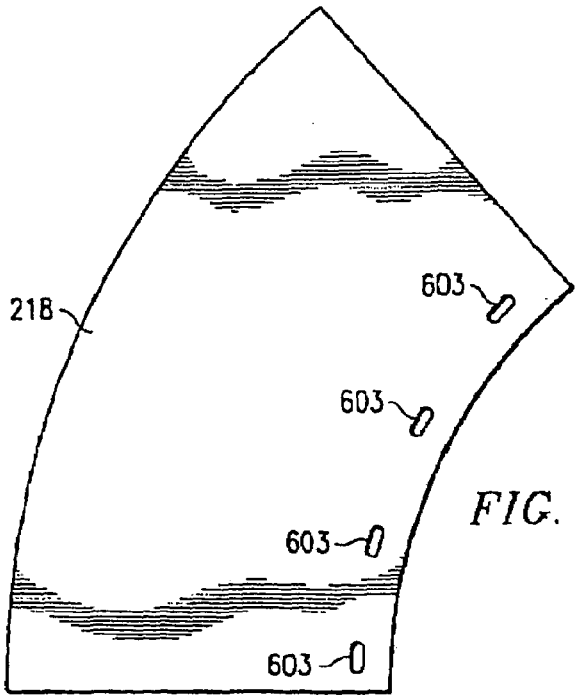
FIG. 6 is a plan view illustrating a sealing member incorporating teachings of the present invention.

In FIG. 6, a plan view illustrating a sealing member incorporating teachings of the present invention is shown. Sealing members 218, 221 and 224 may be made from any suitable elastomeric material. Preferably, the material chosen to form sealing members 218, 221 and 224 is abrasion resistant and semi-rigid. In one embodiment of the present invention, the sealing member employed on environmental shield 203 may be made from multiple smaller seals. However, other embodiments of forming sealing members 218, 221 and 224 are considered within the scope of the present invention.

Sealing members 218, 221 and 224 preferably include apertures 603 along one edge. Apertures 603 enable sealing members 218, 221 and 224 to be operably engaged with discharge lips 303 and 306 preferably using studs 230.

Although the disclosed embodiments have been described in detail, it should be understood that various changes, substitutions and alterations can be made to the embodiments without departing from their spirit and scope.

What is claimed is:

1. A charging hopper for use in charging a rotatable mixer, the rotatable mixer including a drum having a drum opening at one end for receiving and discharging contents, the charging hopper comprising:

a chute having a charging opening and a discharge opening at respective ends thereof;

the chute having a first position operably coupled with the drum such that the discharge opening is disposed proximate the drum opening;

a discharge cover having respective first and second edges and respective first and second faces;

the first edge of the discharge cover operably coupled to the chute proximate the discharge opening;

a plurality of shield fingers operably disposed on the discharge cover;

at least one flexible sealing member having respective first and second faces; and the at least one flexible sealing member attached to the discharge cover proximate the second edge such that the flexible sealing member engages at least a lower portion of the drum opening when the chute is in its first position, wherein the shield fingers operable to engage the flexible sealing member and to maintain the flexible sealing member and the lower portion of the drum opening in generally sealed engagement during charging of the rotatable mixer.

2. The charging hopper of claim 1 further comprising:

a discharge lip operably disposed proximate the second edge of the discharge cover;

the discharge lip operable to engage the flexible sealing member such that the flexible sealing member may be maintained in a generally concave shape with respect to the first face; and the first face operable to engage at least the lower portion of the drum opening.

3. The charging hopper of claim 1 further comprising spring biased shield fingers.

4. The charging hopper of claim 1 further comprising:

at least one gusset having respective first and second ends; and the first end operably disposed on the first face of the discharge cover and the second end operably disposed on the chute.

5. The charging hopper of claim 1 further comprising:

a bracket operably disposed on the chute proximate the charging opening; and the bracket operable to couple to the rotatable mixer such that the charging hopper may be pivoted between at least a charging position and discharging position.

6. The charging hopper of claim 1 further comprising:

a plurality of studs operably coupled to the discharge cover proximate the second edge; and the studs operable to couple the flexible sealing member to the discharge cover.

7. A concrete mixer comprising:

a rotatable drum maintained in a frame;

a drum opening at one end of the drum operable to receive contents to be agitated and further operable to discharge agitated contents from the drum;

a motor operably coupled to the drum to rotate the drum in the frame;

a charging hopper including a chute, a charging opening and a discharge opening;

the charging hopper operably disposed proximate the drum opening;

an environmental shield operably disposed proximate the discharge opening of the charging hopper;

the environmental shield including a discharge cover having respective first and second faces, a first edge and generally curved second edge;

the discharge cover operably coupled to the chute along the first edge;

a generally flexible sealing member operably disposed on the second generally curved edge of the discharge cover, with the generally flexible sealing member operable to engage the drum opening such that undesired leakage of contents therefrom may be reduced; and a plurality of spring biased shield fingers operably coupled to the discharge cover and the generally flexible sealing member; and wherein the spring biased shield fingers are operable to maintain a leakage reducing seal between the generally flexible sealing member and at least a portion of the drum opening.

8. The concrete mixer of claim 7 further comprising the flexible sealing member having a generally concave configuration.

9. The concrete mixer of claim 7 further comprising:

a plurality of gussets having respective first and second ends; and the first end operably coupled to the first face of the discharge cover and the second end operably coupled to the chute.

10. The concrete mixer of claim 7 further comprising the charging hopper movably coupled to the drum such that the charging hopper may move from a first, charging position to a second, discharging position.

11. The concrete mixer of claim 7 further comprising:

a discharge lip operably coupled proximate the generally curved second edge of the discharge cover and to a first edge of the generally flexible sealing member; and the discharge lip disposed at an angle with respect to the first face of the discharge cover.

12. A concrete mixer comprising:

a rotatable drum maintained in a frame;

a drum opening at one end of the drum operable to receive contents to be agitated and further operable to discharge agitated contents from the drum;

a motor operably coupled to the drum to rotate the drum in the frame;

a charging hopper including a chute, a charging opening and a discharge opening;

the charging hopper operably disposed proximate the drum opening;

an environmental shield operably disposed proximate the discharge opening of the charging hopper;

the environmental shield including a discharge cover having respective first and second faces, a first edge and generally curved second edge;

the discharge cover operably coupled to the chute along the first edge;

a generally flexible sealing member operably disposed on the second generally curved edge of the discharge cover; with the generally flexible sealing member operable to engage the drum opening such that undesired leakage of contents therefrom may be reduced; and a plurality of studs operably coupled to the generally curved second edge of the discharge cover; with the studs operable to couple the generally flexible sealing member to the discharge cover.

13. A concrete mixer truck having a rotatable mixer mounted thereon, the rotatable mixer including a drum with a drum opening at one end for receiving contents into and discharging contents from the drum comprising:

a charging hopper having a discharge opening proximate a first end of a chute and a charging opening proximate a second end of the chute;

the discharge opening disposed proximate the drum opening when the charging hopper is in a first position;

an environmental shield operably disposed proximate the discharge opening of the charging hopper when the charging hopper is in the first position;

the environmental shield including a discharge cover and at least one sealing member operably coupled thereto with the sealing member operable to engage at least a lower portion of the drum opening when the charging hopper is in the first position such that leakage of contents therefrom may be reduced and a plurality of shield fingers operably disposed proximate a first edge of the discharge cover; with the shield fingers operable to maintain the engagement between the sealing member and the drum opening when the charging hopper is in the first position.

14. The concrete mixer truck of claim 13 further comprising:

at least one gusset having respective first and second ends operably coupled to a first face of the discharge cover on the first end; and the second end of the at least one gusset operably coupled to the charging hopper.

15. The concrete mixer truck of claim 13 further comprising:

a discharge lip operably disposed proximate a first edge of the discharge cover; and the discharge lip operable to couple the flexible sealing member to the discharge cover such that the sealing member is maintained in a generally concave disposition with respect to a second face of the discharge cover.

16. The concrete mixer truck of claim 13 further comprising a plurality of spring biased shield fingers.

17. The concrete mixer truck of claim 13 further comprising:

a bracket operably coupled to the drum and to the charging hopper; and the charging hopper operable to move about the bracket such that the mixer may assume a second, discharging operation.

* * * * *